US005679276A

United States Patent [19]

Benavides et al.

[11] Patent Number: 5,679,276

[45] Date of Patent: Oct. 21, 1997

[54] FOIL ELECTRICAL CONNECTOR FOR AN OIL BURNER NOZZLE

[75] Inventors: Rafael Benavides, Hof; Werner Doehla, Gefrees; Walter Steeb, Doehlau-Tauperlitz, all of Germany

[73] Assignee: Rapa Rausch & Pausch Elektrotechnische Spezialfabrik GmbH, Selb, Germany

[21] Appl. No.: 379,615

[22] PCT Filed: Aug. 6, 1993

[86] PCT No.: PCT/EP93/02099

§ 371 Date: Apr. 28, 1995

§ 102(e) Date: Apr. 28, 1995

[87] PCT Pub. No.: WO94/04872

PCT Pub. Date: Mar. 3, 1994

[30] Foreign Application Priority Data

Aug. 17, 1992 [DE] Germany ..... 42 27 177.0

[51] Int. Cl.[6] ..... H05B 3/08; H01C 3/06

[52] U.S. Cl. ..... 219/541; 219/544; 338/210; 338/212

[58] Field of Search ..... 219/541, 544, 219/548, 549, 552, 553; 338/22 R, 210, 212, 332; 239/135, 139; 431/207, 208, 209, 11, 36, 41; 137/341; 123/549

[56] References Cited

U.S. PATENT DOCUMENTS

| | | | |
|---|---|---|---|
| 4,354,822 | 10/1982 | Madsen et al. | 431/208 |
| 4,447,706 | 5/1984 | Eder et al. | 123/549 |
| 4,789,850 | 12/1988 | Sepso et al. | 338/22 R |
| 4,861,966 | 8/1989 | Matthiesen et al. | 123/549 |
| 5,212,466 | 5/1993 | Yamada et al. | 338/22 R |
| 5,241,741 | 9/1993 | Sugaya | 338/22 R |

FOREIGN PATENT DOCUMENTS

| | | |
|---|---|---|
| 0017057 | 10/1980 | European Pat. Off. . |
| 463581 | 1/1992 | European Pat. Off. . |
| 2919763 | 7/1983 | Germany . |
| 9206570 | 4/1992 | WIPO . |

*Primary Examiner*—Teresa J. Walberg
*Assistant Examiner*—Sam Paik
*Attorney, Agent, or Firm*—Jordan and Hamburg

[57] ABSTRACT

An electrical assembly for an oil burner nozzle has a heating element and a conductive foil assembly for supplying current to the heating element. The conductive foil assembly has a base material in the form of an electrically insulating sheet configured to extend from the heating element in the oil burner nozzle to an access position accessible from outside the oil burner nozzle. Foil conductors are disposed on the electrically insulating sheet and extend from the access position to the heating element. Another electrically insulating sheet selectively covers the foil conductor in a sandwiched arrangement. The conductive foil assembly is folded around the heating element and portions of the foil conductors are placed into electrical contact with the heating element via non-insulated areas of the foil conductors provided by the selective covering. Access apertures are provided in at least one of the electrically insulating sheets at the access position to allow application of electric power to the foil conductors.

6 Claims, 5 Drawing Sheets

FOIL ELECTRICAL CONNECTOR FOR AN OIL BURNER NOZZLE

BACKGROUND OF THE INVENTION

The invention relates to an oil burner nozzle assembly and a foil conductor assembly for providing a heater connection.

It has already been proposed to dispose electrical components required for the operation of an oil burner into an interior of a nozzle assembly. Particulary in those cases where required conductors are disposed in the interior of the nozzle assembly having installation parameters of an existing plant, a size reduction of the electrical components, including conductors and contacts is essential. Furthermore it is known (for example from the DE-PS 29 19 763) to provide oil preheaters arranged within the nozzle assembly with PTC-heating elements. In this case two PTC wafers exhibiting two contacting areas are electrically contacted by soldered wires or imposed contacting films and then embedded into an electrically insulating foil and insulating substance, respectively. These known solutions require considerably high expenditures in manual assembly which makes assembly errors inevitable. Moreover, with that kind of contacting arrangement a plurality of electrical connections exist being susceptible to interference.

SUMMARY OF THE INVENTION

It is an object of the present invention to provide an oil burner nozzle assembly including electrical components which obviates the disadvantages of the state of art and at the same time permits production at low expenditures for assembly.

The advantages of the present invention are to be found in a considerable reduction of expenditures for assembly due to the direct contacting of the electrical components in the nozzle assembly, particularly of the PTC-heating elements provided at the pre-heater, by virtue of a conducting foil which exhibits non-insulated conductive areas and definedly positioned soldering terminals.

Assembling errors are substantially eliminated due to a considerable reduction of the assembling operations. Additionally, the reduction of electrical connections subject to interferences enhances the operational safety. The invention permits a compact installation of the electrical contacting units required, at the same time additional special electric insulation measures are obviated, particularly for the PTC-heating elements. A neat wiring of the units is obtained and testing of the electrical units before final assembly is facilitated.

BRIEF DESCRIPTION OF THE DRAWINGS

The invention is explained in more detail by virtue of the schematical views of the following embodiments. In the drawings

DETAILED DESCRIPTION OF THE INVENTION

Figure 1:
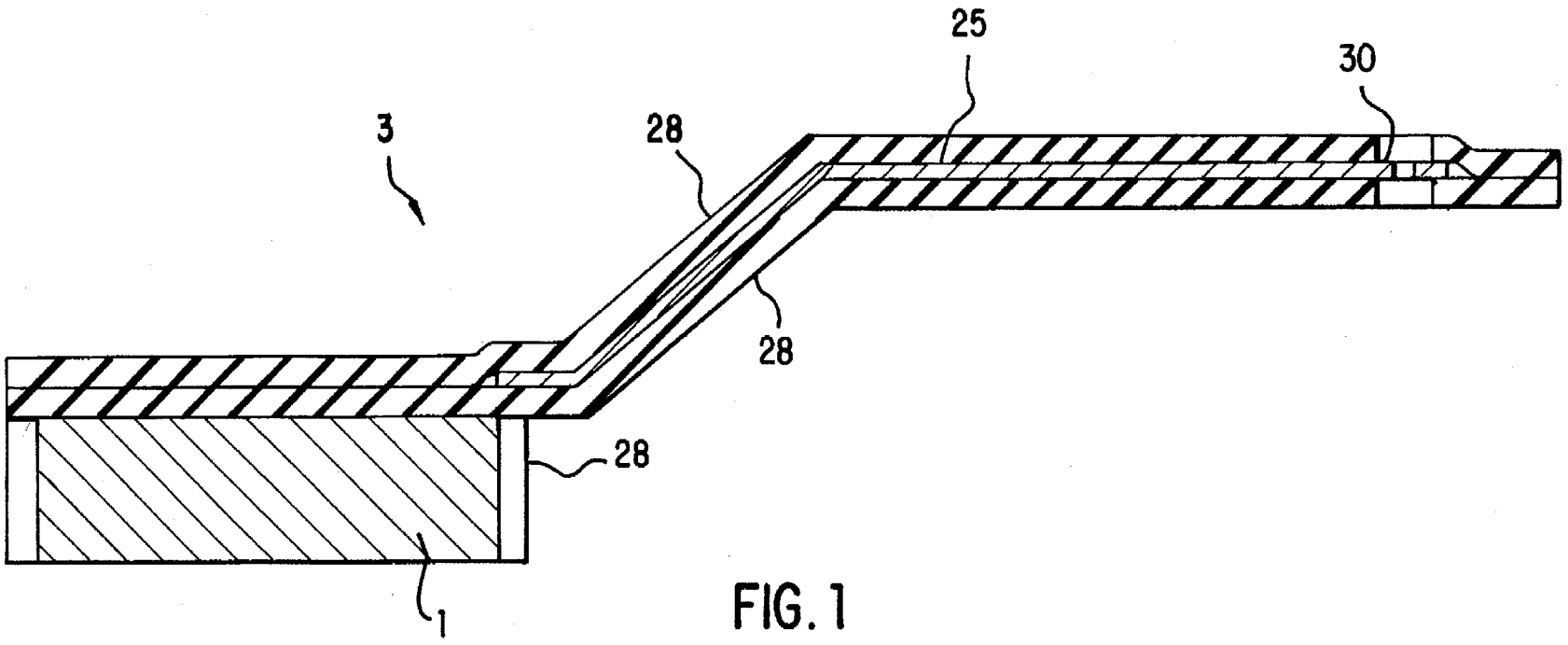
FIG. 1 shows a lateral cross-sectional view of a PTC-heating element inserted into a conducting foil assembly provided with non-insulated conductive areas.
Figure 2:
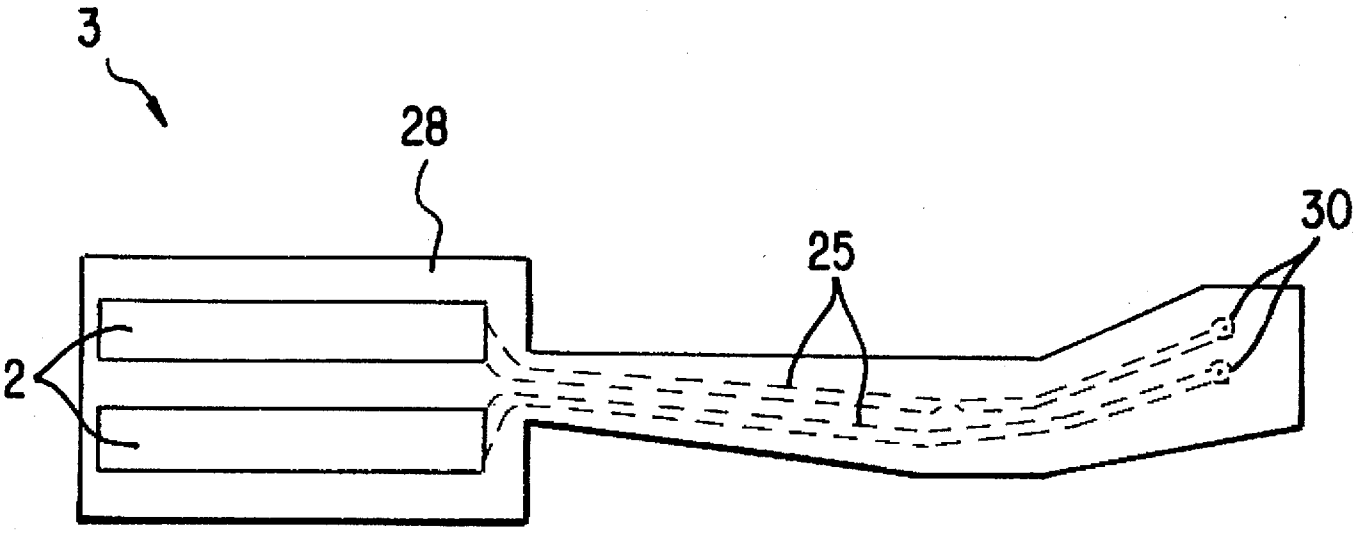
FIG. 2 is a plan view of the conducting foil assembly of FIG. 1 unfolded.

Referring to FIGS. 1 and 2, a PTC-heating element 1 is shown contacted by a conducting foil assembly 3 having non-insulated conducting areas 2. The conducting foil assembly 3 is dimensioned and folded so that the PTC-heating element 1 is, via its side faces, or at least via its contact faces 27, entirely enveloped as shown in FIG. 4 and, additionally, electrically insulated by electrical insulation sheets 28 acting as a conducting foil base material. The conductive paths 25 on the conducting foil assembly 3, shown in dashed lines in FIGS. 2 and 3, are provided with the electrical insulation sheets 28 on both sides with exception of the areas of the soldering terminals 30 and non-insulated conducting areas 2.

FIG. 2 shows the conducting foil assembly 3 of FIG. 1 unfolded, exposing the electrical non-insulated conducting areas 2 which meet the contact faces 27 of the PTC-heating element 1 in the folded state. The electrical insulation of the remaining conductive paths provided by the electrical insulation sheets 28 is indicated by dashed lines.

Figure 3:
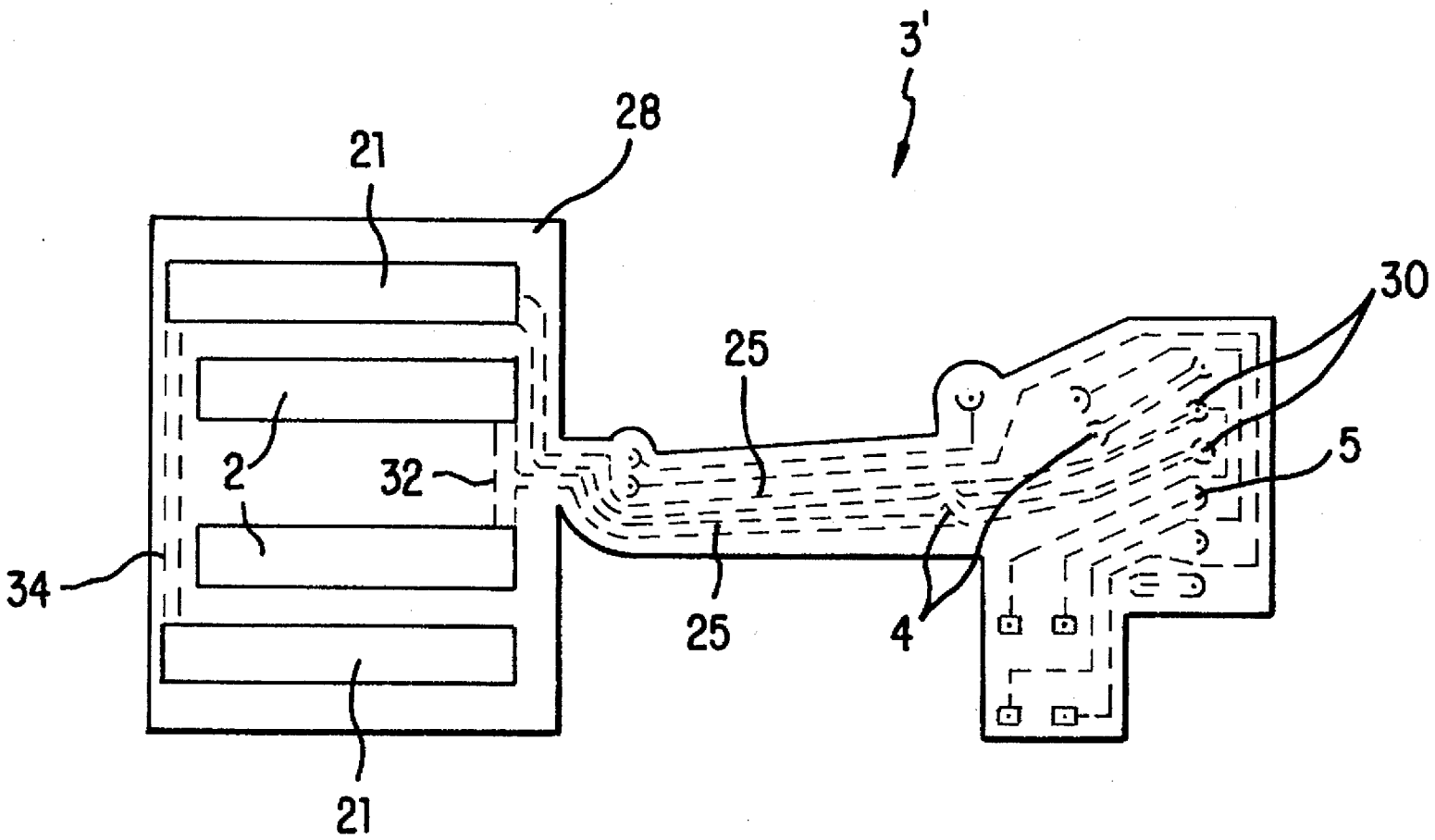
FIG. 3 is an unfolded conducting foil assembly adapted to receive two PTC-heating elements and to provide connections for further electrical units.
Figure 4:
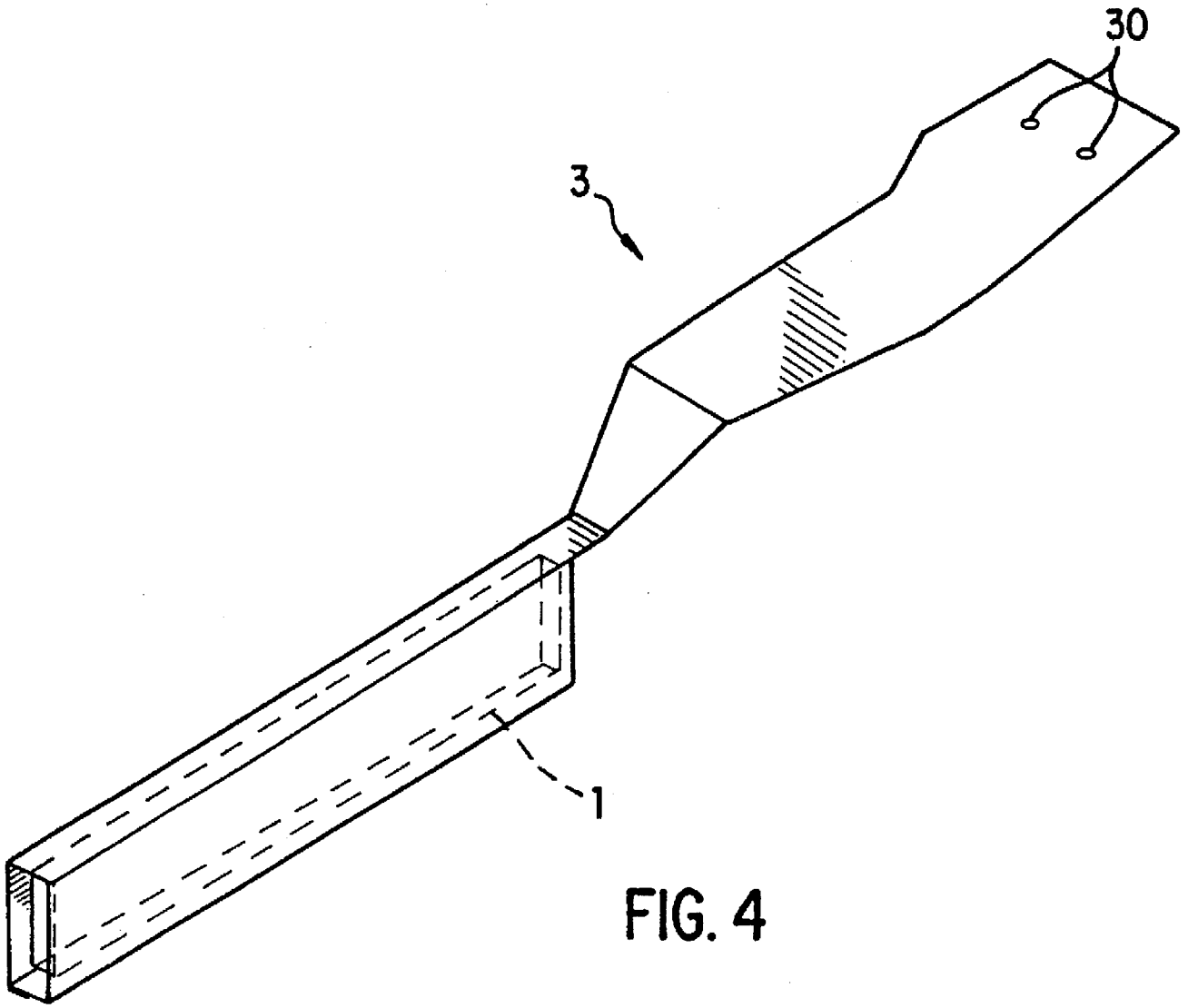
FIG. 4 is a perspective view of the conducting foil assembly of FIG. 1 and a PTC-heating element.
Figure 5:
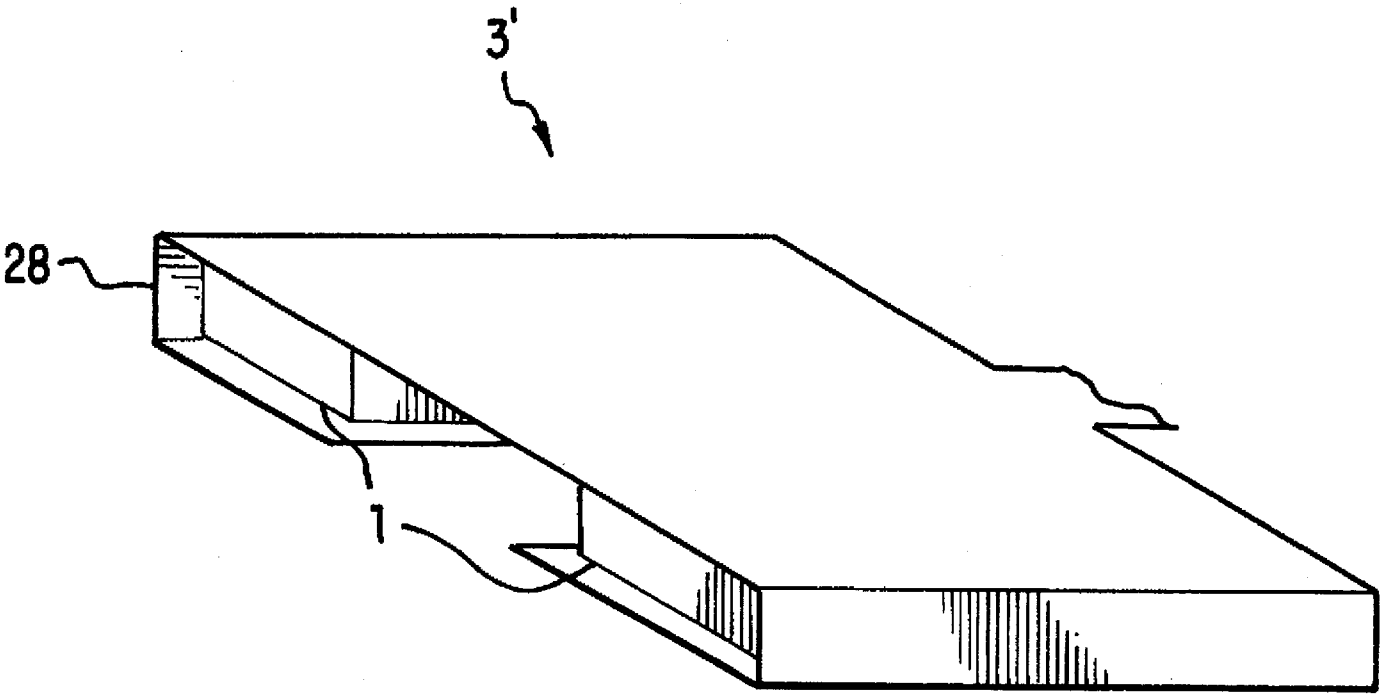
FIG. 5 is a perspective view of the conducting foil assembly of FIG. 3 and PTC-heating elements.

FIGS. 3 and 5 show a conducting foil assembly 3' unfolded, adapted to receive two PTC-heating elements when folded. The non-insulated conducting areas 2 and 21, are so connected to one another that the conducting ranges 2 and 21 which make contact with the PTC-heating element 1, are respectively on equal potential in the operation state due to respective interconnecting conductors 32 and 34. In this embodiment additional soldering terminals 4 are provided for enabling contact to, for example, contact means such as contact pins of a thermostat integral with the nozzle assembly.

It lies within the scope of this invention to provide, if required, additional conductive paths and terminals on the conductive foil assembly 3 which permit contact to, for example, a magnet valve, not shown in detail, and other electrical components in the nozzle assembly.

The folded conducting foil assembly 3, enclosing at least one PTC-heating element 1 is clamped upon a fuel duct of the nozzle assembly. The conducting foil assembly 3+ offers twice the number of non-insulated conducting areas as PTC-heating elements employed. The external electrical connection of the components of the nozzle assembly contacted via the conducting foil is established via contacts 5 not specified in detail.

It lies within the scope of the invention to provide further non-insulated conducting areas for contacting further PTC-heating elements. Furthermore, it is feasible to slot the conducting foil between the conductive areas. It further lies within the scope of the invention to employ more than one conducting foil, the use of one foil, however, is the most advantageous solution as concerns costs.

We claim:

1. An oil burner nozzle assembly for an oil burner nozzle, the oil burner nozzle assembly comprising:

at least one heating element; an electrically insulating sheet;

a conducting foil disposed on said electrically insulating sheet for supplying current within the oil burner nozzle assembly and to said heating element;

said electrically insulating sheet being folded around said heating element;

said conducting foil having a non-insulated contact area positioned such that said non-insulated contact area contacts a contact area of said at least one heating element; and said conducting foil having a terminal contact area for applying electrical power to said heating element.

2. An oil burner nozzle assembly as claimed in claim 1, further comprising said conducting foil having soldering terminals positioned to meet contact areas of electrical components of the oil burner nozzle assembly other than said heating element.

3. An oil burner nozzle assembly according to claim 1, further comprising:

a second conducting foil disposed on said insulating sheet;

said heating element having opposing side contacts;

said second conducting foil having non-insulated contact areas disposed such that said non-insulated contact areas make electrical contact with respective ones of said opposing side contacts when said oil burner nozzle assembly is folded over said heating element; and said second conducting foil having a terminal contact area for applying electrical power to said heating element.

4. An oil burner nozzle assembly as claimed in claim 1, wherein the conducting foil is provided with twice the number of non-insulated contact areas as a heating element has contacts.

5. A heating element assembly for an oil burner nozzle, comprising:

first and second electrically insulating sheets;

foil conductors interposed between said electrically insulating sheets;

a heating element having electric contacts and at least a portion of said electrically insulating sheets folded over the heating element;

one of said electrically insulating sheets being configured such that said foil conductors make electrical contact with said electric contacts of said heating element;

said foil conductors each having a contact terminal; and at least one of said insulating sheets having apertures permitting electric power to be applied to said contact terminals to power the heating element.

6. The heating element assembly for an oil burner nozzle according to claim 5, further comprising:

second foil conductors interposed between said electrically insulating sheets;

a second heating element having electric contacts and at least a portion of said electrically insulating sheets folded over the second heating element;

one of said electrically insulating sheets being configured such that said second foil conductors make electrical contact with said electric contacts of said second heating element;

said second foil conductors each having a contact terminal; and at least one of said insulating sheets having apertures permitting electric power to be applied to said contact terminals of said second foil conductors to power the second heating element.

* * * * *